US008708032B2

(12) United States Patent
Newcomb

(10) Patent No.: US 8,708,032 B2
(45) Date of Patent: Apr. 29, 2014

(54) METHOD AND SYSTEM FOR INTERNAL CLEANING OF COMPLEX CASTINGS

(75) Inventor: Thomas P. Newcomb, Defiance, OH (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/407,834

(22) Filed: Feb. 29, 2012

(65) Prior Publication Data

US 2012/0152485 A1 Jun. 21, 2012

Related U.S. Application Data

(62) Division of application No. 12/169,343, filed on Jul. 8, 2008, now Pat. No. 8,186,419.

(51) Int. Cl.
*B22D 29/00* (2006.01)
*B22D 27/08* (2006.01)

(52) U.S. Cl.
USPC ..... 164/404; 164/260; 164/345

(58) Field of Classification Search
USPC ..... 164/213, 223, 227, 260, 344, 345, 401, 164/404
See application file for complete search history.

(56) References Cited

U.S. PATENT DOCUMENTS

| | | | | |
|---|---|---|---|---|
| 3,738,415 A | | 6/1973 | Planten | |
| 4,001,976 A | * | 1/1977 | MacMillan | 451/81 |
| 4,777,689 A | * | 10/1988 | Brenner et al. | 15/94 |
| 4,894,959 A | | 1/1990 | Hoover | |
| 5,499,519 A | | 3/1996 | Brunier et al. | |
| 6,615,901 B2 | | 9/2003 | Kaminski et al. | |
| 2006/0272792 A1 | | 12/2006 | Massin | |

FOREIGN PATENT DOCUMENTS

| | | |
|---|---|---|
| AT | 003791 U1 | 8/2000 |
| CN | 2083960 U | 9/1991 |
| DE | 29921056 U1 | 2/2000 |
| JP | 61009961 A | 1/1986 |

OTHER PUBLICATIONS

Machine Translation of AT3791.*
Swingmaster SM 315; Product Data Sheet; Fill Gesellschaft M.B.H.

* cited by examiner

*Primary Examiner* — Kevin P Kerns
*Assistant Examiner* — Steven Ha
(74) *Attorney, Agent, or Firm* — Fraser Clemens Martin & Miller LLC; J. Douglas Miller

(57) ABSTRACT

A decoring method and system is provided. The method includes the steps of providing the casting having a core material disposed in the internal passage; providing the decoring apparatus configured to selectively oscillate the casting and selectively rotate the casting; securing the casting in the decoring apparatus; introducing a quantity of shot into the internal passage of the casting; oscillating the casting; and rotating the casting. A decoring apparatus configured to selectively oscillate the casting along a first axis, rotate the casting about a second axis, and rotate the casting about a third axis, is also provided.

6 Claims, 2 Drawing Sheets

METHOD AND SYSTEM FOR INTERNAL CLEANING OF COMPLEX CASTINGS

CROSS-REFERENCE TO RELATED APPLICATIONS

Figure 1:
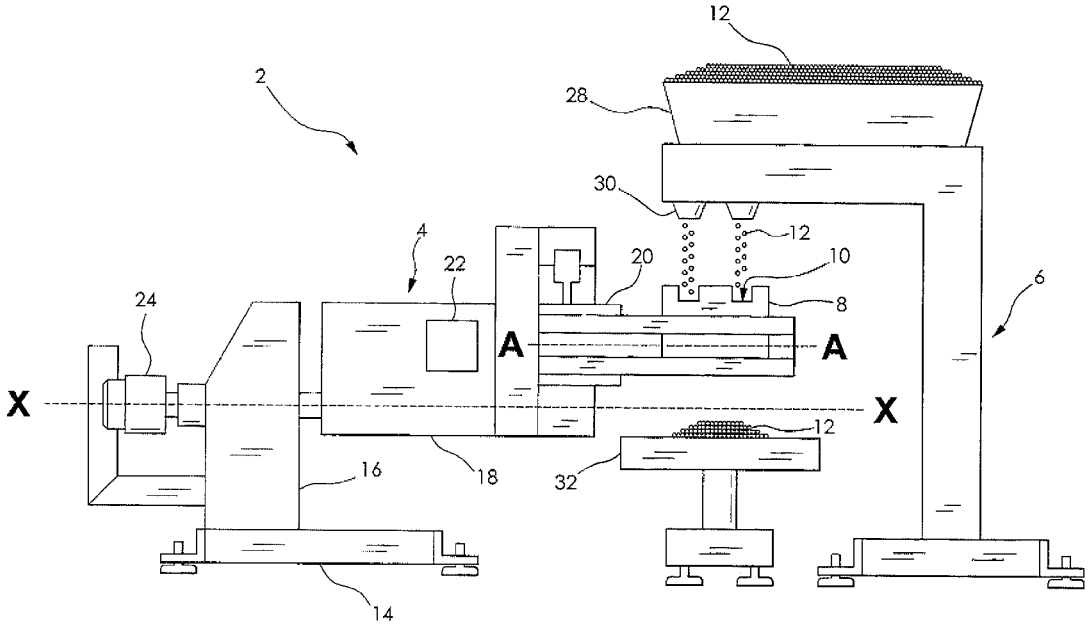

This application is a divisional of U.S. Pat. No. 8,186,419, filed on Jul. 8, 2008. The entire disclosure of the above patent is hereby incorporated herein by reference.

FIELD OF THE INVENTION

The present disclosure relates to decoring of castings and, in particular, a method and apparatus for cleaning core sand from internal passages of engine castings.

BACKGROUND OF THE INVENTION

In precision sand casting processes for forming a casting, such as for an internal combustion engine block, an expendable mold package is assembled from resin-bonded sand cores. The sand cores define the internal and external surfaces of the casting. Resin-coated foundry sand is generally blown into a core box and cured to form the expendable mold package. A typical mold package is shown and described in commonly owned U.S. Pat. No. 6,615,901, the disclosure of which is incorporated herein by reference in its entirety.

Following the pouring of molten metal such as aluminum or cast iron to form a casting, the sand cores must be removed in a process known as "decoring". A decoring machine is generally employed to remove the sand core material from the casting. The casting is typically pre-processed prior to loading the casting into the decoring machine. Pre-processing may include a high energy impacting of the casting, for example, using pneumatic hammers and the like. The impacting fractures the internal cores, allowing at least a limited amount of core movement inside internal passages of the casting. The decoring machine exploits the limited core movement to cause a further breakdown of the core into flowable sand.

A typical decoring machine may employ the shaking principle for further pulverizing the sand core and transporting the core material outwardly from the decoring machine. A known decoring machine employing the shaking principle is the Swingmaster™ decoring machine, manufactured by Fill Gesellschaft m.b.H. in Austria and distributed in North America by Rimrock Corporation in Columbus, Ohio. The Swingmaster™ decoring machine is described in Austrian Patent No. 003791, hereby incorporated herein by reference in its entirety. The Swingmaster™ decoring machine has two unbalanced type shafts that create a direct force in the direction of the swing that results in a sinusoidal vibration of the casting. The Swingmaster™ decoring machine removes cores from the casting by subjecting the casting to sinusoidal vibration of sufficient amplitude, and simultaneously rotating the casting about a horizontal axis, to break down the core. The rotation of the casting about the horizontal axis by the decoring machine may further allow free-flowing sand and core material to fall from the internal passages of the casting. The remaining core material is allowed to move more freely within the passages upon removal of the free-flowing sand and core material, hastening the pulverization and eventual removal of the core from the casting. A significant amount of the core can thereby be broken down and removed from the internal passages of the casting.

The typical decoring machine and process do not remove individual sand grains that may adhere to the casting wall due to phenomena known as "metal penetration" and "burn on". The removal of the adhered material in the internal passages of complex castings is typically accomplished by subsequent processing. The removal of the adhered material may be accomplished by at least one of: surface impact means such as shot blasting and the like; abrasive means such as grinding, vibratory media cleaning, brushing, chiseling and the like; erosive means such as high velocity water jet and the like; and high energy mechanical shock such as electric arc/water-submerged processing and the like. Each of these methods undesirably adds to the cost and complexity of the decoring process.

There is a continuing need for a cost-effective method and system to remove core sand and other contaminants from narrow passages in aluminum and cast iron castings. Desirably, the method and system maximize the reliability of cleaning complex castings.

SUMMARY OF THE INVENTION

In concordance with the instant disclosure, a cost-effective method and system for removing core sand and other contaminants from narrow passages of castings, and which maximize the reliability of cleaning complex castings, is surprisingly discovered.

In one embodiment, a method for decoring a casting having an internal passage, includes the steps of: providing the casting having core material disposed in the internal passage; providing the decoring apparatus configured to selectively oscillate the casting and selectively rotate the casting; securing the casting in the decoring apparatus; introducing a quantity of shot into the internal passage of the casting; oscillating the casting; and rotating the casting The shot is thereby caused to impact a surface of the internal passage by the oscillation and rotation of the casting to remove the core material therefrom. The core material and shot is caused to exit the internal passages of the casting by the rotation of the casting.

In a further embodiment, a system for decoring a casting having an internal passage includes a decoring apparatus and a shot dispenser. The decoring apparatus is configured to selectively oscillate a casting and selectively rotate the casting. The shot dispenser is in communication with the casting and adapted to deliver a quantity of shot to the internal passage of the casting.

In another embodiment, a decoring apparatus for a casting having an internal passage includes a stationary base with a frame disposed thereon. A rotor is rotatably coupled to the frame. A clamping assembly for securely holding the casting is coupled to the rotor. A first motor is coupled to the clamping assembly and configured to selective oscillate the casting along a first axis. A second motor is coupled to the rotor and configured to selectively rotate the casting about a second axis. A third motor is disposed on the clamping assembly and configured to selectively rotate the casting about a third axis.

DRAWINGS

The above, as well as other advantages of the present disclosure, will become readily apparent to those skilled in the art from the following detailed description, particularly when considered in the light of the drawings described hereafter.

Figure 2:
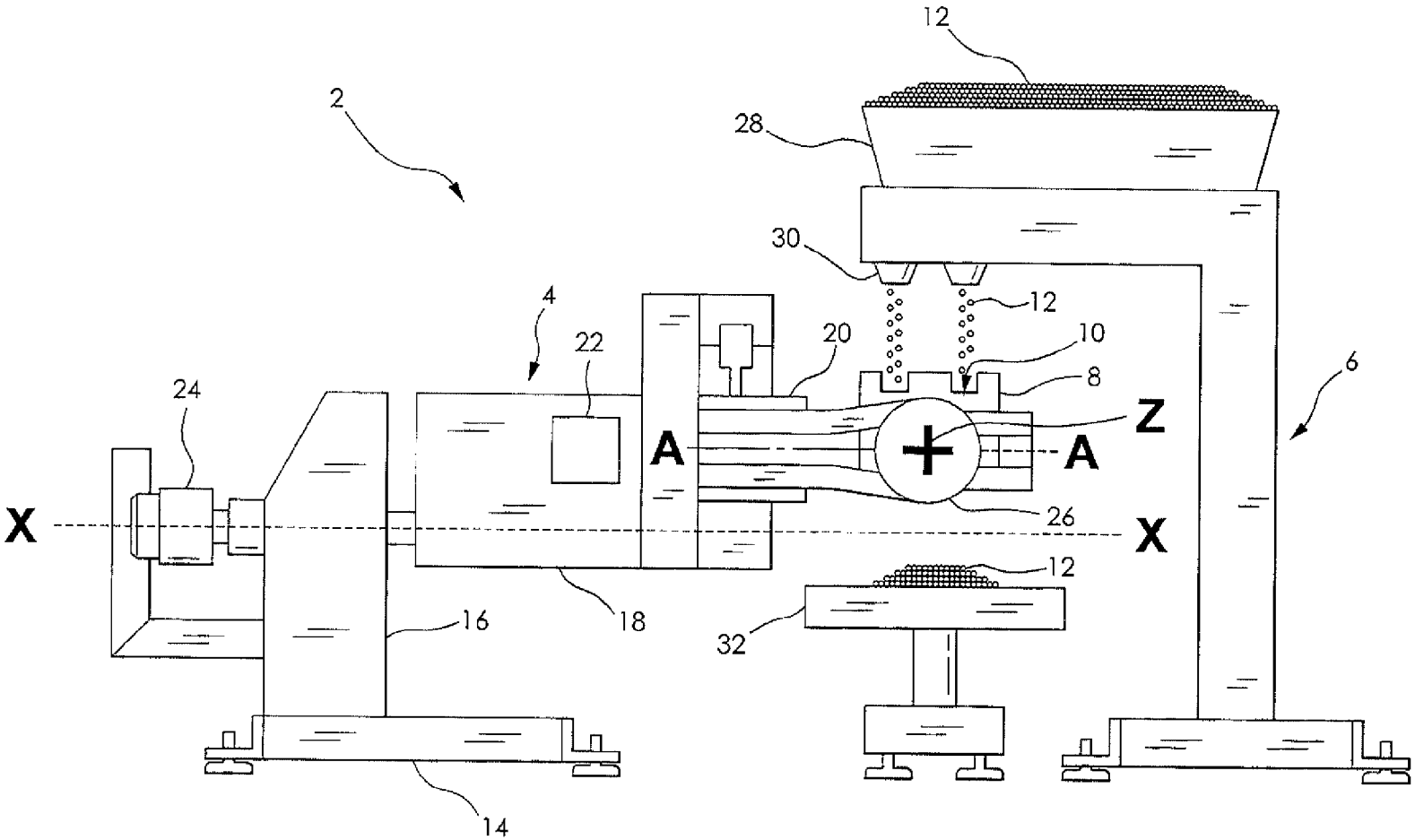

FIG. 1 is a side elevational view of a decoring system according to an embodiment of the present disclosure; and FIG. 2 is a side elevational view of a decoring system according to another embodiment of the present disclosure.

DETAILED DESCRIPTION OF THE INVENTION

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical.

In FIG. 1, a decoring system 2 according to the present disclosure includes a decoring apparatus 4 and a shot dispenser 6 for cleaning a casting 8 having at least one internal passage 10. The internal passage 10 may be a complex internal passage, for example, forming a tortuous path through the interior of the casting 8. The shot dispenser 6 is in communication with the casting 8 and adapted to deliver a quantity of shot 12 to the internal passage 10 of the casting 8, as desired. The decoring apparatus 4 is configured to selectively oscillate the casting 8 along a first axis A. The first axis A may be substantially parallel with a second axis X about which the casting 8 is selectively rotated. In particular embodiments, the first axis A and the second axis X may be substantially the same. Although a variety of suitable first axis A and second axis X may be selected, the first axis A and the second axis X may desirably be substantially horizontal in relation to a floor on which the decoring apparatus 4 is supported.

A suitable decoring apparatus 4 is known in the art as the Swingmaster™ decoring machine, described hereinabove. A skilled artisan may select another suitable decoring apparatus as desired. In a particular embodiment, the decoring apparatus 4 includes a stationary base 14 with a frame 16 disposed thereon. The frame 16 is coupled to a rotor 18. The rotor 18 is selectively rotatable about the second axis X. The rotor 18 is coupled to a clamping assembly 20. The clamping assembly is configured to selectively and securely hold the casting 8. As a nonlimiting example, the clamping assembly 20 may include a servo motor coupled to a pair of neoprene rubber grips. Other suitable clamping assembly 20 designs may also be employed.

The decoring apparatus 4 may include a first motor 22 and a second motor 24. The first motor 22 may be coupled to the clamping assembly 20 and configured to selectively oscillate the casting 8 along the first axis A. The oscillation may be a substantially sinusoidal vibration, for example, in the direction of the first axis A. The oscillation may be caused, for example, by counter-rotating parallel, out-of-balance shafts driven via gears and elastic belts by the first motor 22. The oscillation of the casting 8 may be conducted at a decoring frequency of up to about 25 Hz, and at an acceleration of up to about 300 m/sec$^2$, for example. Other suitable means for causing the oscillation, decoring frequencies, accelerations, and like parameters may also be selected.

The second motor 24 may be coupled to the rotor 18 and configured to selectively rotate the casting 8 about the second axis X. The rotation of the casting 8 may be conducted from about −90 degrees to about +180 degrees, for example. The rotation may be employed to dispose substantially downward an originally upward facing aperture to the internal passage 10 formed in the casting 8. An exiting of the core material and shot may thereby be facilitated by the rotation of the casting 8 by the second motor 24. A skilled artisan may select suitable degrees of rotation of the casting 8 about the second axis X, as desired.

Referring to FIG. 2, the decoring apparatus 4 may include a third motor 26. The third motor 26 is configured to selectively rotate the casting about a third axis Z. As a nonlimiting example, the third motor 26 is disposed on the clamping assembly 20 of the decoring apparatus 4. The third motor 26 may be disposed on the decoring apparatus 4 at another location suitable for selectively rotating the casting 8 about the third axis Z, as desired. In particular embodiments, the third motor 26 is configured to selectively tilt the casting 8 at an angle relative to a plane formed by the axes Z and X during an operation of the decoring apparatus to optimize a cleaning of the internal passage 10 of the casting 8.

With renewed reference to FIG. 1, the shot dispenser 6 according to the present disclosure may be one of manual means and automated means, such as a robot. The shot dispenser 6 may be configured to introduce the shot 12 into the internal passage 10 of the casting 8 according to one or more programmable robotic subroutines. The shot 12 may be formed from a metallic material, and in particular embodiments from a ferrous material. A skilled artisan should appreciate that other suitable shot 12 materials may also be selected.

In one example, the shot dispenser 6 includes a hopper 28. The hopper 28 is configured to hold the shot 12 prior to delivery of the shot 12 to the internal passage 10 of the casting 8. The shot dispenser 6 may further include at least one conduit 30 in communication with the hopper 28. The at least one conduit 30 may be configured to gravity feed the shot 12 to the internal passage 10 of the casting 8 as desired. A shot flow control means (not shown) may further be used to regulate the flow of the shot 12.

In a further embodiment, the decoring system 2 may include a separating apparatus 32. The separating apparatus 32 is disposed generally underneath the clamping assembly 20 and the casting 8. The separating apparatus 32 is configured to separate the shot 12 from the core material exiting the internal passage 10 of the casting 8 during operation of the decoring apparatus 4. As a nonlimiting example, the separating apparatus 32 may include a screen (not shown) configured to separate the shot 12 from the core material. To facilitate the separation from the substantially pulverized core material, the size of the shot 12 may be up to about 0.5 mm in diameter, in a particular embodiment up to about 1 mm in diameter, and in a most particular embodiment up to about 2 mm in diameter on average. Other suitable average shot sizes may also be employed.

In another nonlimiting example, the separating apparatus 32 includes a magnet (not shown) configured to magnetically separate the shot 12 from the core material. The magnet may be employed when the shot 12 is formed from a material sufficiently influenced by a magnet field. For example, the magnet may be employed when the shot 12 is formed from a ferrous material, such as steel. The magnet may be disposed under a receiving belt (not shown) and adapted to attract the shot 12 to the belt as the core material is transported by the belt to a disposal or recycling unit (not shown). The distance between the magnet 12 and the belt may then be increased after disposal of the core material, or alternatively turned "off" in the case of an electromagnet, to cause the shot 12 to be appropriately removed from the belt and recycled, for example, by return to the hopper 28.

The present disclosure further includes a method for decoring the casting 8 having the internal passage 10. The method first includes the steps of providing the casting 8 having the core material disposed in the internal passage 10, and providing the decoring apparatus 4 configured to selectively oscillate the casting 8 along the first axis A and selectively rotate the casting 8 about the second axis X. The casting 8 is then secured in the decoring apparatus 4, for example, with the clamping assembly 20.

Following the securing of the casting 8 in the decoring apparatus 4, a quantity of the shot 12 is introduced into the casting 8. The shot 12 may be introduced via the normally upwardly disposed aperture of the internal passage 10 in the casting 8. The casting 8 is then oscillated along the first axis A and rotated about the second axis X to cause the shot 12 to impact the walls of the internal passage 10. The oscillation pulverizes and fluidizes the core material disposed in the internal passage 10. Due to the shaking, oscillating action of the clamping assembly 20, the shot 12 repeatedly ricochets through and impacts the internal passage 10 with sufficient energy to at least one of fracture and dislodge any adhered core material, such as sand particles, therefrom. The shot 12 thereby minimizes the need for additional processing, such as shot blasting and the like.

It should be appreciated that when the casting 8 is rotated, the core material disposed in the internal passage 10 is caused to exit the internal passage, typically under the force of gravity. The core material and used shot 12 may be emptied into the separating apparatus 32 as the casting 8 is rotated, for at least one of separation, recycling and disposal, as desired. It should also be understood that the rotation of the casting 8 about second axis X may contribute to a greater cleaning of the internal passage 10. To further facilitate the cleaning of the internal passage 10 by causing the shot 12 to impact in all directions, the method of the present disclosure may further include the step of rotating the casting about the third axis Z.

The method of the disclosure may further include the step of pre-processing the casting 8 to initiate a breakdown of the core material prior to securing the casting 8 in the decoring apparatus 4. For example, the pre-processing may include high energy impacting of the casting, such as with pneumatic hammers, at a separate core cracking hammer station. Following the securing of the casting 8 in the decoring apparatus 4, but prior to the introduction of the shot 12, the casting 8 may also be at least one of pre-oscillated and pre-rotated as desired to further break down and pulverize the core material disposed in the internal passage 10.

In a further embodiment, the method of the disclosure includes the step of separating the shot 12 from the core material. The separation step is conducted following the exiting of the core material and the shot 12 from the internal passage 10 of the casting 8. The separation step may include magnetic separation of the shot 12, as described hereinabove, if the shot 12 is formed from a ferrous material. The shot 12 may then be recycled by reintroducing the separated shot 12 back into the internal passage 10 of the casting 8 for further cleaning of the internal passage 10.

It should be appreciated that the present decoring system 2 and method are cost-effective by eliminating a need for an additional post-processing step, such as shot blasting and the like. It is surprisingly found that the decoring system 2 and method of the disclosure are effective in removing core sand and other contaminants from narrow and complex internal passage 10 of the casting 8 for an engine block. The decoring system 2 and method thereby maximize the reliability of cleaning the casting 8.

While certain representative embodiments and details have been shown for purposes of illustrating the invention, it will be apparent to those skilled in the art that various changes may be made without departing from the scope of the disclosure, which is further described in the following appended claims.

What is claimed is:

1. A decoring apparatus for a casting having an internal passage, the decoring apparatus comprising:

a stationary base with a frame disposed thereon;

a rotor rotatably coupled to the frame;

a clamping assembly coupled to the rotor for securely holding the casting;

a first motor coupled to the clamping assembly and configured to selectively oscillate the casting along a first axis;

a second motor coupled to the rotor and configured to selectively rotate the casting about a second axis; and a third motor disposed directly on the clamping assembly and configured to selectively rotate the casting about a third axis, the third axis having an orientation different from the second axis.

2. The decoring apparatus according to claim 1, further comprising a shot dispenser in communication with the casting and adapted to deliver shot to the internal passage of the casting.

3. The decoring apparatus according to claim 2, wherein the shot dispenser includes at least one conduit, the conduit including an outlet pointed toward the internal passage and configured to gravity feed the shot directly into the internal passage of the casting.

4. The decoring apparatus according to claim 3, wherein the shot dispenser includes a hopper for holding the shot prior to delivery to the internal passage of the casting.

5. The decoring apparatus according to claim 4, wherein the at least one conduit is in communication with the hopper.

6. The decoring apparatus according to claim 5, further comprising a separating apparatus in communication with the decoring apparatus and configured to separate the shot from core material exiting the internal passage of the casting.

* * * * *